United States Patent [19]

Shindou et al.

[11] Patent Number: 4,812,371

[45] Date of Patent: Mar. 14, 1989

[54] ZN-AL HOT-DIP GALVANIZED STEEL SHEET HAVING IMPROVED RESISTANCE AGAINST SECULAR PEELING OF COATING

[75] Inventors: Yoshio Shindou; Motoo Kabeya, both of Kimitsu, Japan

[73] Assignee: Nippon Steel Corporation, Tokyo, Japan

[21] Appl. No.: 81,664

[22] Filed: Aug. 4, 1987

Related U.S. Application Data

[62] Division of Ser. No. 931,636, Nov. 17, 1986.

[51] Int. Cl.[4] ..... B32B 15/18

[52] U.S. Cl. ..... 428/659; 420/514; 420/519

[58] Field of Search ..... 428/659; 420/514, 519; 427/398.3, 433

[56] References Cited

U.S. PATENT DOCUMENTS

| | | | |
|---|---|---|---|
| 3,320,040 | 5/1967 | Roe et al. | 428/659 |
| 3,782,909 | 1/1974 | Cleary et al. | 428/653 |
| 4,056,366 | 11/1977 | Lee et al. | 428/659 |
| 4,383,006 | 5/1983 | Shindo et al. | 428/659 |
| 4,448,748 | 5/1984 | Radtke et al. | 420/519 |
| 4,610,936 | 9/1986 | Isobe et al. | 428/659 |

FOREIGN PATENT DOCUMENTS

| | | | |
|---|---|---|---|
| 57-67153 | 4/1982 | Japan . | |
| 58-177450 | 10/1983 | Japan . | |
| 58-177446 | 10/1983 | Japan | 427/433 |
| 60-52569 | 3/1985 | Japan . | |
| 8400039 | 1/1984 | World Int. Prop. O. | 420/519 |

*Primary Examiner*—L. Dewayne Rutledge
*Assistant Examiner*—Robert L. McDowell

[57] ABSTRACT

A Zn-Al hot-dip galvanized coating on a steel sheet may exhibit intergranular corrosion and be degraded due to the Al's secular enrichment in the grain boundaries of coating. This is prevented in accordance with the present invention by the galvanizing bath composition which contains from 0.15 to 10% of Al, from 0.1 to 1% of Sb, from 0.01 to 2% of Si, and the balance being Zn and unavoidable impurities such as Pb, Sn, and Cd in an amount less than 0.02%, and additionally contains at least from 0.01 to 1% of at least one member selected from the group consisting of Mg and mischmetal.

4 Claims, No Drawings

ZN-AL HOT-DIP GALVANIZED STEEL SHEET HAVING IMPROVED RESISTANCE AGAINST SECULAR PEELING OF COATING

This is a division of application Ser. No. 931,636, filed Nov. 17, 1986.

BACKGROUND OF THE INVENTION

1. Field of the Invention

The present invention relates to a hot-dip galvanized steel sheet having a zinc-aluminum alloy galvanized layer (hereinafter referred to as the Zn-Al galvanized steel sheet), and a method for producing the. same. More particularly, the present invention relates to a method for preventing an intergranular corrosion of a galvanized layer and propagation of cracks due to intergranular corrosion which occurs when the Zn-Al galvanized steel sheet is stored for a long period of time inside a house or in a high temperature- and a high humidity-atmosphere (90° C. or higher and 90% or higher of RH), and also for preventing an embrittled galvanized layer from peeling from the steel base, due to embrittlement of galvanized layer.

2. Description of the Related Arts

Zinc-galvanized steel sheet is the most widely used among surface-treated steel sheets. The requests by users for the qualities of zinc-galvanized steel sheets to be enhanced increase year by year. Recently, in order to provide products which can meet the demands for enhanced corrosion-resistance, workability, and paintability, sheets galvanized with multi-components, such as Zn-Al, have been seriously researched and developed.

When a zinc-galvanized steel sheet using an inexpensive base metal of zinc undergoes a secular change when inside a house or is exposed to a high temperature- and high humidity environment, intergranular corrosion occurs. When the intergranular corrosion advances, the galvanized layer becomes embrittled and, hence, peels away from the steel base. This phenomena of intergranular corrosion, embrittlement and peeling of the galvanized layer occurs frequently even in the case of a Zn-Al galvanized layer having an improved corrosion resistance, with the result that the quality is greatly impaired.

According to an example for improving the resistance against the secular peeling of a Zn-Al galvanized steel sheet disclosed in Japanese Unexamined Patent Publication No. 57-67153 by the present assignee, the composition of a galvanizing bath is adjusted to from 0.1 to less 0.2% of Al, from 0.1 to 0.5% of Sb, and from 0.01 to 5% of at least one element selected from the group consisting of Mg, Cu, Cr, Ni, Co and Mn, and 0.02% at the highest of unavoidable impurities, such as Pb, Sn, and Cd, the balance being Zn.

According to another example disclosed in Japanese Unexamined Patent Publication No. 58-177450, which is related to a method for producing a composite hot-dip galvanized steel sheet, the composition of a hot-dip Zn-Al galvanizing bath which contains from more than 40% to 70% of Al, and from more than 0.5% to 10% of Si, additionally contains at least one of 0.01 to 1.0% of Mg, 0.01 to 0.5% of Mn, and 0.01 to 2.0% of misch metal, as well as from 0.01 to 0.5% of Sb, and the contents of unavoidable impurities are controlled to 0.1% or less of Pb and 0.02% or less of Sn.

The above-mentioned methods intend to prevent the embrittlement of a galvanized layer while not impairing an inherently high corrosion resistance of Al of the Zn-Al galvanized layer.

SUMMARY OF THE INVENTION

It is an object of the present invention to further enhance the corrosion resistance attained by the method of Japanese Unexamined Patent Publication No. 55-141,310.

It is another object of the present invention to suppress the peeling due to secular embrittlement, which is peculiar to the Zn-Al galvanized steel sheet, while enhancing the corrosion resistance.

In accordance with the objects of the present invention, there is provided a Zn-Al galvanized steel sheet having an improved corrosion-resistance and resistance against the secular peeling, characterized by being galvanized on a low carbon steel sheet using a galvanizing bath which contains from 0.15 to 10% of Al, from 0.1 to 1% of Sb, from 0.01 to 2% of Si, and the balance being Zn and unavoidable impurities such as Pb, Sn, and Cd in an amount less than 0.02%, and additionally contains at least from 0.01 to 1% of at least one member selected from the group consisting of Mg and Misch metal.

There is also provided a method for producing a Zn-Al galvanized steel sheet characterized by, directly before the solidification of a galvanizing layer, i.e., while in the semimolten state, blowing a mist of an aqueous phosphate solution onto the galvanizing layer to thereby rapidly cool the Zn-Al galvanized steel sheet at a speed of from 50° to 300° C./second. The Zn-Al galvanized steel sheet produced by this method has an improved corrosion resistance, and an improved resistance against the secular peeling of the coating, as well as a refined, smooth and pleasing spangled appearance.

The corrosion resistance of Zn-Al galvanized steel sheet according to the present invention is improved with regard- to the following technical points.

(1) Aluminum, which enriches in the grain boundar of a galvanized coating or in or in the vicinity of an Fe alloy layer, is eutectic-solidified due to Sb, with the result that aluminum, which is active, is passivated. One technical improvement resides therefore in that the intergranular corrosion of a galvanized coating, and the propagation and expansion of intergranular corrosion-cracks resulting from the intergranular corrosion, as well as peeling of the galvanized layer from the steel base, are eliminated.

(2) A technical improvement resides in the point that misch metal is used for suppressing the abnormal growth of an Fe-Zn alloy layer or Fe-Al alloy layer, which is formed at the interface between the steel base and galvanized coating, and for enhancing the corrosion resistance and adherence of the galvanized coating, and for improving the galvanized appearance so as to obtain a pleasing metallic luster.

(3) Another technical improvement resides in the point that Mg and Si are used in combination for suppressing the anode corrosion of particularly $\beta$-Zn phase of a Zn-Al galvanized steel sheet broadening passivation regions of the galvanized coating, and further, improving the corrosion resistance.

(4) A further technical improvement resides in, directly before the solidification of the zinc galvanized coating subjecting depending upon necessity, coarse spangles formed on the surface of a Zn-Al galvanized steel sheet to an appropriate rapid-cooling treatment, thereby obtaining refined, smooth spangles with a metallic luster.

The reasons for limiting the galvanizing bath composition and the rapid cooling treatment are hereinafter described.

(a) Aluminum

The function and effect of Al in the Zn-Al galvanized steel sheet according to the present invention differs depending upon the amount of Al in the galvanizing bath. When Al is less than 0.15%, the Al-Zn eutectic is not formed appreciably, and therefore, an enhancement of the corrosion resistance of a galvanized coating is not to be expected. In addition, the ternary alloy layer of Fe-Al-Zn is not formed uniformly on the steel interface, and therefore, the abnormal growth of a binary Fe-Zn alloy layer, which is brittle in working, occurs. In this case, the stability of an initial adherence of a galvanized coating is deficient. The lower limit of Al amount is set as 0.15 wt %, taking into consideration that the above mentioned ternary alloy layer is uniformly formed at the steel base to ensure a stable adherence of the galvanized coating. On the other hand, in accordance with the increase in the Al amount in the galvanizing bath, Al tends to result in heterogeneous phases of a galvanized coating, such that a $\eta$ phase (Zn), a $\beta$-Zn phase (Zn-Al having a high Zn content), and an $\alpha$-Zn phase (Zn-Al having a high Al content) are mixed in an intricate manner. In accordance with a further increase in the Al content, the crystallization of the $\alpha$-Zn phase and $\beta$-Zn phase occurs predominantly, and the corrosion resistance of a Zn-Al galvanized steel sheet is enhanced. However, the thermal diffusion reaction between Al and Fe at the steel interface occurs incidentally and is promoted exceedingly with the increase in the amount of Al in the galvanizing bath, and thus the abnormal growth of an Fe-Al alloy layer, which is brittle in working, occurs. In this case, there is a danger of incurring the degradation of the initial adherence of the coating, and also a degradation of the corrosion resistance, such as the generation of red spot stains in a humid atmosphere. Furthermore, Fe-Al compounds may dissolve into the galvanizing bath and be incorporated into the galvanized coating to form projections on the galvanized surface. There projections cause abrasion and the incidental generation of surface flaws, which thus degrades the appearance. A countermeasure for preventing the above becomes necessary, such as removing the Fe-Al compounds by a filter. The incorporation of Fe-Al compounds into the galvanized coating becomes disadvantageously serious when the Al exceeds 10 wt %.

The lower limit of Al amount in the galvanizing bath is 0.15 wt % in the present invention as described above. A preferable lower limit of Al amount is 0.2 wt %, since this ensures a stable adherence of galvanized coating in a continuous, high speed galvanizing line. The higher limit of Al in the galvanizing bath of 10 wt % is determined to provide improved qualities, such as a high corrosion resistance of the Zn-Al galvanized steel sheet, and to avoid erosion in environmental galvanized appliances, uch as stands, sink rolls, snouts and the like.

(b) Antimony

Sb is one of the most characteristic galvanizing components in the present invention. Sb has the effects of suppressing the intergranular corrosion of a Zn-Al galvanized coating and preventing the peeling of the coating from the steel base. Sb has a function of developing the spangles, and therefore, the size of the spangles can be controlled from coarse grains to fine grains by adjusting the cooling speed.

Regarding the reasons why Sb suppresses the intergranular corrosion of the Zn-Al galvanized coating and hence enhances the resistance against secular peeling of galvanized coating, this is presumed to be as follows. X-ray diffractometry reveals that Al, which enriches in or in the vicinity of the Fe-Al-Zn alloy layer formed in the grain boundaries of galvanized coating or at its interface with steel, solidifies as an eutectic of AlSb. The generation as well as propagation and enlarging of hair cracks in the cross section of galvanized coating under a high-temperature humid condition (95° C., RH>98%, seven days) is prevented. Taking into consideration the X-ray diffractometry and prevention of hair cracks, it is presumed that Al, which is active and forms an eutectic with Sb, is thus passivated or becomes inert; upon formation of a local cell between Al and Zn, the corrosion potential-difference between Al and Zn is decreased; and, finally the local corrosion of Zn is lessened.

Obviously, a certain amount of Sb in proportion to the amount of Al in galvanizing bath is necessary for preventing the secular degradation of galvanized coating in the Zn-Al galvanized steel sheet. However, Sb in an amount exceeding the requisite amount decreases the viscosity of the galvanizing bath, and causes the once solidified galvanized to sag upon non-forced cooling, presumably because Sb is forced out from the liquid phase to the solid phase during the solidification process by an incidental exothermic reaction. Because of this sagging, the galvanized coating appears to have . an unevenness, in the form of undulations, which may occasionally cause abrasion.

The lower limit of Sb is 0.1 wt %, preferably 0.2 wt % in the light of allowing the Sb to promote a satisfactory resistance against secular peeling of a Zn-Al galvanized layer and develop the spangles during the non-forced cooling. The upper limit of Sb is 1 wt %, preferably 0.5 wt %, in the light of smoothening the galvanized appearance.

(c) Silicon

Si is used for suppressing the growth of an Fe-Zn or Fe-Al alloy layer, and enhancing the adherence of the galvanized coating, Si provides a high corrosion resistance to the galvanized coating, because Si segregates in the grain boundaries, and forms an Si oxide which in turn suppresses the oxidation of the $\beta$-Zn phase. When Si is less than 0.01 wt %, the effect of Si for suppressing the growth of the Fe alloy layer is virtually under the control of the Al and is not appreciable. In addition, when Si is less than 0.01 wt %, its eutectic reaction with Al enriched in the grain boundaries of a galvanized coating, and hence an enhanced corrosion resistance of a galvanized coating cannot be expected. On the other hand, when Si is greater than 2.0 wt %, Si exceeds its solubility in the Zn solid phase and precipitates dispersedly in the galvanized coating, so that powdering becomes disadvantageously liable to occur during pressing or other working. Accordingly, the amount of Si is from 0.02 to 1.0 wt %.

(d) Magnesium

Mg crystallizes in the $\beta$-Zn phase of a Zn-Al-Si galvanized coating and is used to further enhance the corrosion resistance. It is necessary to use Mg within a range such that brittle fracturing and local corrosion are not induced by Mg. When Mg is smaller than 0.01 wt %, it virtually does not form a eutectic with Zn, Al, and Si of the galvanizing bath, and hence the effect of electrochemically enlarging the passivation area of the galvanized coating due to the eutectic formation virtually is not realized, with the result that the provision of high corrosion resistance is difficult. On the other hand, when Mn is greater than 1 wt %, Mg, which segregates in the grain boundaries and the like of a galvanized coating forms a cathode and hence induces the selective corrosion of the $\beta$-Zn phases which have a relatively high Zn content. This in turn leads to brittle fracturing due to intergranular corrosion of a galvanized coating and hence peeling of a galvanized coating, which is detrimental in the light of quality, as an article of commerce. Mg is preferably from 0.05 to 0.5 wt %.

(e) Mischmetal

Mischmetal used in the present invention in uniformly dispersed within and refines the crystal grains of $\alpha$-Al. Mischmetal is used therefore for providing smoothness and luster, to the galvanized sheet. When the addition amount of Ce (cerium) mischmetal or La (lanthanum) mischmetal is less than 0.01 wt %, the uniform dispersion of mischmetal in the $\alpha$-Al crystal grains is insufficient for attaining a satisfactory refinement of the crystals. In this case, neither the surface smoothening of the galvanized coating nor the enhancement of the corrosion resistance are effectively attained. On the other hand, when misch metal is greater than 1.0 wt %, it exceeds its solubility in the Zn-Al galvanizing bath and hence is liable to form dross, i.e., the solid floating in the bath. The dross may adhere to the galvanized coating and degrades the quality of the galvanized coating. Therefore, it is necessary to remove the dross from an appliance, which is detrimental to the operational efficiency. A preferable amount of misch metal in the light of smooth and luster appearance is from 0.02 to 0.5 wt %.

(f) Unavoidable impurities

The unavoidable impurities herein indicate those elements, which upon contact and hence formation of local cell with Zn, such elements are for themselves cathodized and promote the anodization of Zn ($Zn \rightarrow Zn^{2+} + 2e$). These elements are Pb, Sn, Cd and the like. These elements therefore induce the intergranular corrosion and brittle fracturing of a galvanized coating, and finally, lead to the peeling of the galvanized coating. These elements are most unfavorable for providing a high corrosion resistance to a galvanized coating. The unavoidable impurities must be eliminated as much as possible, in the present invention. These impurities are unavoidably incorporated into base galvanizing metals during their production process, but should be limited to those incorporated from the base galvanizing metals. The total amount of unavoidable impurities is less than 0.02 wt %, preferably less than 0.01 wt %.

(g) Rapid cooling after galvanizing

The rapid cooling after galvanizing is carried out, if necessary, in the present invention. The rapid cooling after galvanizing has the objects of refining the spangles formed on the surface of galvanized coating and providing a smooth, highly lustered and pleasing appearance of the galvanized layer, required for the base for a layer of paint. The rapid cooling after galvanizing has a premise that it is carried out while the galvanized layer is in a molten or semi-molten state. As high a cooling speed as possible is preferable in order to obtain smooth, uniform and fine spangles. Regarding the methods for increasing the cooling speed in the present invention, either a dry rapid-cooling method or wet rapid-cooling method can be used. In the former method, as is ordinarily used in the fine powder spraying of metal, the sprayed metal is fusion bonded with a galvanized coating, and at this time, absorbs the retained heat of the galvanized coating, thereby rapidly cooling it. In the latter method, any liquid agent, which has a large latent heat of decomposition, such as water or a phosphoric acid aqueous solution, is sprayed onto the galvanized coating in a molten state, so as to rapidly cool it. However, to obtain more smooth, uniform, and refined spangles, the wet method, in which there are much controllable factors, such as concentration, flow rate, diameter of spray mists, and the like, is more preferable than the dry method, in which the operation allowability is limited in the points of fusion-bonding compatibility, melting point or particle diameter. One of the most effective factors for enhancing the cooling rate in the wet, rapid cooling method resides in how to decrease the diameter of the mist particles, and hence to uniformly spray the mist particles. Other factors, such as kinds of agent, concentration, temperature are not expected to have a great influence upon the rapid cooling. A plant, in which a mist with fine particle-diameter is obtained, can be devised taking into consideration the production line characteristics.

When the cooling rate is less than 50° C./sec, such factors as whether the galvanizing deposition amount or steel sheet's thickness has varied, mean that a uniform, fine spangle is occasionally not obtained. This is disadvantageous, since the yield decrease in a hot dip galvanizing line with a high productivity. On the other hand, when the cooling rate is higher than 300° C./sec, the effects of refining the spangles are not appreciable to the naked eye in the light of value as an article of commerce. A cooling rate higher than 300° C./sec is obtained only by an excessive investment cost and leads to contamination of the the working environment around the rapid cooling apparatus and, therefore, should be avoided. A preferred cooling rate is from 100° to 250° C./sec as described above.

The present invention is further described by way of examples.

EXAMPLE

Unannealed, killed steel sheets 0.27 mm thick and 914 mm wide were galvanized using a bath according to the present invention and a comparative bath. The adherence, finishing appearance of galvanized spangles, corrosion resistance of nontreated and unpainted sheets, and the resistance against secular peeling of the galvanized coating are listed in Table 1. The galvanizing was carried out by a Sendzimir type hot dip galvanizing line under the following conditions:

(1) Line speed: 150 m/minute (2) Pretreatment

Sheet temperature at the exit side of a non-oxidizing furnace–600° ~ 650° C.

Sheet temperature at the exit side of a reducing furnace–790° ~ 830° C.

Gas composition in a reducing furnace–25% $H_2$, 75% $N_2$ (3) Mischmetals used

| Mischmetal | Components of Base metal (%) | | Total rare earths (%) |
|---|---|---|---|
| Cerium | Ce (Cerium) | 52.5 | 99.3 |
| | Other rare earths | 47.5 | |
| Lanthanum | La (Lanthanum) | 83 | 98.0 |
| | Ce (Cerium) | 8.5 | |
| | Nd (Nedymium) | 6.5 | |
| | Pr (Paseodymium) | 2 | |

(4) Hot-dip galvanizing: Bath temperature-430°~470° C.

(5) Galvanizing deposition amount (controlled by gas wiping): 100~120 g/m$^2$ (per one side)

(6) Cooling after galvanizing: Cooling in still air or spraying 1% sodium phosphate aqueous solution. In the spray cooling, the aqueous solution was sprayed through a special nozzle toward a galvanizing surface in the molten state. The spraying pressure and distance were adjusted to adjust the cooling speed.

(7) Skin passing after galvanizing: None

The Zn-Al galvanized steel sheets obtained under the above conditions were subjected to tests of the properties thereof by the following method.

(1) Adherence of galvanizing layer

A semispherical steel lump 5 kg in weight and having a radius of ¾ of an inch was dropped under gravity onto galvanized steel sheets from a height of 500 mm, and resulting convex parts of the galvanized coating were forcd to peel by pulling on an adhesive tape attached thereto. The peeling was evaluated under the following criteria ◎: no peeling at all ○: peeling in the form of a few minute spots Δ: peeling over a certain area x: peeling of the entire area (2) Appearance of galvanized spangles Evaluation was carried out by the naked eye under the following criteria.

| Rank | Coarse spangles (Non forced cooling) | Fine spangles (Rapid cooling) |
|---|---|---|
| ◎ | 6 mm or more grain diameter, smooth | Metallic lustre, smooth |
| ○ | 6 mm or more grain diameter, smoothness not good | Semilustre, smooth |
| Δ | Partly composed of grains having a diameter of less than 6 mm | Satin finished surface |
| x | Less than 6 mm grain diameter | Satin finished Surface, blackish |

(3) Corrosion resistance of nonpainted sheets

In the methods of salt spraying testing stipulated under JIS Z-2371, one cycle comprised 8 hours of spraying and 16 hours at a standstill, and the weight loss due to stain formation after seven cycles was obtained. This weight loss was reduced to the corrosion rate per m$^2$ and hour, and was evaluated under the following criteria: ◎-0.1 or less; o-0.3 or less; Δ-0.5 or less; and, x-1.0 or more (g/m$^2$/Hr).

(4) Resistance against secular peeling of galvanized coating

The unpainted, galvanized steel sheets were exposed for 14 days in a wet box at 80° C. and RH 95% ±3%, and then bent with a radius of 3 mm. The galvanized coating of the bent parts was forced to peel by pulling on an adhesive tape attached thereto. The peeling was evaluated under the following criteria.

◎: no peeling at all

○: peeling in the form of a few minute spots

Δ: peeling which results in cohesive destruction of the galvanized coating.

x: entirely peeled from the steel base.

TABLE 1

| Distinction | No. | Composition of Galvanizing Bath (wt %) Al | Sb | Si | Mg | Ce misch metal | La misch Metal | Impurities | Zn | Rapid cooling rate after plating (°C./sec) | Appearance of galvanized finish | Adherence of galvanized layer | Corrosion resistance of uncoated sheet | Resistance against secular peeling of galvanized coating |
|---|---|---|---|---|---|---|---|---|---|---|---|---|---|---|
| Invention | 1 | 0.15 | 0.20 | 0.1 | 0.1 | 0 | 0 | 0.015 | balance | 150 | ◎ | ○ | Δ~○ | ◎ |
| Invention | 2 | 0.20 | 0.20 | 0.1 | 0.1 | 0 | 0 | 0.015 | " | 150 | " | ○~◎ | Δ~○ | " |
| Invention | 3 | 4.50 | 0.20 | 0.1 | 0.1 | 0 | 0 | 0.015 | " | 150 | " | ◎ | ○ | " |
| Invention | 4 | 10.0 | 0.20 | 0.1 | 0.1 | 0 | 0 | 0.015 | " | 150 | " | " | ◎ | " |
| Invention | 5 | 4.50 | 0.15 | 0.1 | 0.1 | 0 | 0 | 0.015 | " | 150 | " | " | ○ | " |
| Invention | 6 | 4.50 | 0.30 | 0.1 | 0.1 | 0 | 0 | 0.015 | " | 150 | " | " | ○ | " |
| Invention | 7 | 4.50 | 0.50 | 0.1 | 0.1 | 0 | 0 | 0.015 | " | 150 | " | " | ○ | " |
| Invention | 8 | 4.50 | 0.70 | 0.1 | 0.1 | 0 | 0 | 0.015 | " | 150 | " | " | ○ | " |
| Invention | 9 | 4.50 | 1.0 | 0.1 | 0.1 | 0 | 0 | 0.015 | " | 150 | " | " | ○ | " |
| Invention | 10 | 4.50 | 0.35 | 0.01 | 0.1 | 0 | 0 | 0.015 | " | 150 | " | ○~◎ | ○ | - |
| Invention | 11 | 4.50 | 0.35 | 0.05 | 0.1 | 0 | 0 | 0.015 | " | 150 | " | ◎ | ○ | " |
| Inven- | 12 | 4.50 | 0.35 | 0.50 | 0.1 | 0 | 0 | 0.015 | " | 150 | " | " | ○~◎ | " |

TABLE 1-continued

| Distinction | No. | Composition of Galvanizing Bath (wt %) Al | Sb | Si | Mg | Ce misch metal | La misch Metal | Impurities | Zn | Rapid cooling rate after plating (°C./sec) | Appearance of galvanized finish | Adherence of galvanized layer | Corrosion resistance of uncoated sheet | Resistance against secular peeling of galvanized coating |
|---|---|---|---|---|---|---|---|---|---|---|---|---|---|---|
| tion | | | | | | | | | | | | | | |
| Invention | 13 | 4.50 | 0.35 | 1.0 | 0.1 | 0 | 0 | 0.015 | " | 150 | " | " | ○~◎ | " |
| Invention | 14 | 4.50 | 0.35 | 2.0 | 0.1 | 0 | 0 | 0.015 | " | 150 | " | " | ○~◎ | " |
| Invention | 15 | 4.50 | 0.35 | 0.50 | 0.01 | 0 | 0 | 0.015 | " | 150 | " | " | ○~◎ | " |
| Invention | 16 | 4.50 | 0.35 | 0.50 | 0.05 | 0 | 0 | 0.015 | " | 150 | " | " | ○~◎ | " |
| Invention | 17 | 4.50 | 0.35 | 0.50 | 0.07 | 0 | 0 | 0.015 | " | 150 | " | " | ○~◎ | " |
| Invention | 18 | 4.50 | 0.35 | 0.50 | 0.30 | 0 | 0 | 0.015 | balance | 150 | ◎ | ◎ | ◎ | ◎ |
| Invention | 19 | 4.50 | 0.35 | 0.50 | 0.50 | 0 | 0 | 0.015 | " | 150 | " | " | ◎ | " |
| Invention | 20 | 4.50 | 0.35 | 0.50 | 0.70 | 0 | 0 | 0.015 | " | 150 | " | " | ◎ | " |
| Invention | 21 | 4.50 | 0.35 | 0.50 | 1.0 | 0 | 0 | 0.015 | " | 150 | " | " | ◎ | " |
| Invention | 22 | 0.20 | 0.20 | 0.1 | 0.1 | 0 | 0 | 0.015 | " | Non-forced cooling | | " | Δ~○ | " |
| Invention | 23 | 0.20 | 0.20 | 0.1 | 0.1 | 0 | 0 | 0.015 | " | 50 | ○~◎ | " | Δ~○ | " |
| Invention | 24 | 0.20 | 0.20 | 0.1 | 0.1 | 0 | 0 | 0.015 | " | 100 | ◎ | " | Δ~○ | " |
| Invention | 25 | 0.20 | 0.20 | 0.1 | 0.1 | 0 | 0 | 0.015 | " | 200 | " | " | Δ~○ | " |
| Invention | 26 | 0.20 | 0.20 | 0.1 | 0.1 | 0 | 0 | 0.015 | " | 300 | " | " | Δ~○ | " |
| Invention | 27 | 4.50 | 0.3 | 0.5 | 0.3 | 0 | 0 | 0.015 | " | Non-forced cooling | ○ | " | ◎ | " |
| Invention | 28 | 4.50 | 0.3 | 0.5 | 0.3 | 0 | 0 | 0.015 | " | 50 | ○~◎ | " | ◎ | " |
| Invention | 29 | 4.50 | 0.3 | 0.5 | 0.3 | 0 | 0 | 0.015 | " | 100 | ◎ | " | " | " |
| Invention | 30 | 4.50 | 0.3 | 0.5 | 0.3 | 0 | 0 | 0.015 | " | 200 | " | " | " | " |
| Invention | 31 | 4.50 | 0.3 | 0.5 | 0.3 | 0 | 0 | 0.015 | " | 300 | " | " | " | " |
| Invention | 32 | 10.0 | 0.5 | 1.0 | 0.3 | 0 | 0 | 0.015 | " | Non-forced cooling | ○ | " | " | " |
| Invention | 33 | 10.0 | 0.5 | 1.0 | 0.3 | 0 | 0 | 0.015 | balance | 50 | ○~◎ | ◎ | ◎ | ◎ |
| Invention | 34 | 10.0 | 0.5 | 1.0 | 0.3 | 0 | 0 | 0.015 | " | 100 | ◎ | " | " | " |
| Invention | 35 | 10.0 | 0.5 | 1.0 | 0.3 | 0 | 0 | 0.015 | " | 200 | " | " | " | " |
| Invention | 36 | 10.0 | 0.5 | 1.0 | 0.3 | 0 | 0 | 0.015 | " | 300 | " | " | " | " |
| Invention | 37 | 4.50 | 0.2 | 0.1 | 0.1 | 0.01 | 0 | 0.015 | " | Non-forced cooling | ◎ | " | " | " |
| Invention | 38 | 4.50 | 0.2 | 0.1 | 0.1 | 0.02 | 0 | 0.015 | " | Non-forced cooling | " | " | " | " |
| Invention | 39 | 4.50 | 0.2 | 0.1 | 0.1 | 0.10 | 0 | 0.015 | " | Non-forced cooling | " | " | " | " |
| Invention | 40 | 4.50 | 0.2 | 0.1 | 0.1 | 0.50 | 0 | 0.015 | " | 50 | " | " | " | " |
| Invention | 41 | 4.50 | 0.2 | 0.1 | 0.1 | 0.90 | 0 | 0.015 | " | 50 | " | " | " | " |
| Invention | 42 | 4.50 | 0.2 | 0.1 | 0.1 | 0 | 0.01 | 0.015 | " | 50 | " | " | " | " |
| Invention | 43 | 4.50 | 0.2 | 0.1 | 0.1 | 0 | 0.10 | 0.015 | " | 50 | " | " | " | " |
| Invention | 44 | 4.50 | 0.2 | 0.1 | 0.1 | 0 | 0.50 | 0.015 | " | Non-forced cooling | " | " | " | " |
| Invention | 45 | 4.50 | 0.2 | 0.1 | 0.1 | 0 | 0.90 | 0.015 | " | Non-forced cooling | " | " | " | " |
| Inven- | 46 | 4.50 | 0.2 | 0.1 | 0.1 | 0.03 | 0.05 | 0.015 | " | 50 | " | " | " | " |

TABLE 1-continued

| Distinction | No. | Composition of Galvanizing Bath (wt %) Al | Sb | Si | Mg | Ce misch metal | La misch Metal | Impurities | Zn | Rapid cooling rate after plating (°C./sec) | Appearance of galvanized finish | Adherence of galvanized layer | Corrosion resistance of uncoated sheet | Resistance against secular peeling of galvanized coating |
|---|---|---|---|---|---|---|---|---|---|---|---|---|---|---|
| tion | | | | | | | | | | | | | | |
| Invention | 47 | 4.50 | 0.2 | 0.1 | 0.1 | 0.10 | 0.10 | 0.015 | " | 50 | " | " | " | " |
| Invention | 48 | 4.50 | 0.2 | 0.1 | 0.1 | 0.50 | 0.50 | 0.015 | " | 50 | " | " | " | " |
| Invention | 49 | 4.50 | 0.2 | 0.1 | 0 | 0.10 | 0 | 0.015 | " | 50 | " | " | " | " |
| Invention | 50 | 4.50 | 0.2 | 0.1 | 0 | 0 | 0.10 | 0.015 | " | 50 | " | " | " | " |
| Comparative | 51 | 0.1 | 0.06 | 0.008 | 0.006 | 0 | 0 | 0.015 | " | 150 | ○ | x | x | Δ~○ |
| Comparative | 52 | 0.1 | 2.0 | 0.008 | 0.006 | 0 | 0 | 0.015 | " | 150 | ○~◎ | x | x | ◎ |
| Comparative | 53 | 0.1 | 2.0 | 3.0 | 0.006 | 0 | 0 | 0.015 | " | 150 | Δ~○ | x | Δ~○ | ○~◎ |
| Comparative | 54 | 0.1 | 2.0 | 3.0 | 2.0 | 0 | 0 | 0.015 | " | 150 | x~Δ | x | ○ | x~Δ |
| Comparative | 55 | 0.1 | 2.0 | 3.0 | 2.0 | 0 | 0 | 0.015 | " | Non-forced cooling | Δ | x | ○ | x |
| Comparative | 56 | 12.5 | 0.06 | 0.008 | 0.006 | 0 | 0 | 0.015 | " | 150 | Δ | x~Δ | ○~◎ | x |
| Comparative | 57 | 12.5 | 2.0 | 0.008 | 0.006 | 0 | 0 | 0.015 | " | 150 | Δ~○ | x~Δ | ○~◎ | ○ |
| Comparative | 58 | 12.5 | 2.0 | 3.0 | 0.006 | 0 | 0 | 0.015 | " | 150 | Δ | ◎ | ○~◎ | ○ |
| Comparative | 59 | 12.5 | 2.0 | 3.0 | 1.5 | 0 | 0 | 0.015 | " | 150 | x~Δ | x~Δ | ○~◎ | x |
| Comparative | 60 | 12.5 | 2.0 | 3.0 | 1.5 | 0 | 0 | 0.015 | " | 150 | x~Δ | x~Δ | ○~○ | x |
| Comparative | 61 | 0.2 | 0.06 | 0.007 | 0.006 | 0 | 0 | 0.015 | " | 35 | Δ~○ | ◎ | Δ | x |
| Comparative | 62 | 0.2 | 0.06 | 0.007 | 0.006 | 0 | 0 | 0.015 | " | 350 | Δ | ◎ | Δ | x |
| Comparative | 63 | 4.5 | 0.3 | 0.3 | 0.1 | 1.5 | 0 | 0.015 | balance | Non-forced cooling | Δ | ◎ | ○~◎ | ◎ |
| Comparative | 64 | 4.5 | 0.3 | 0.3 | 0.1 | 0 | 1.5 | 0.015 | " | Non-forced cooling | Δ | ◎ | ○~◎ | ◎ |
| Comparative | 65 | 4.5 | 0.3 | 0.3 | 0 | 1.5 | 0 | 0.015 | " | Non-forced cooling | Δ | ◎ | ○ | ○ |
| Comparative | 66 | 4.5 | 0.3 | 0.3 | 0 | 0 | 1.5 | 0.015 | " | Non-forced cooling | Δ | ◎ | ○ | ○ |
| Comparative | 67 | 4.5 | 0.3 | 0.3 | 0 | 0 | 0 | 0.02 | " | 100 | ◎ | ◎ | Δ | x |
| Comparative | 68 | 4.5 | 0.3 | 0.3 | 0 | 0 | 0 | 0.10 | " | 100 | ◎ | ○ | Δ | x |

The characteristics of the method according to the present invention are described with reference to Table 1.

(1) Resistanoe against secular peeling of galvanized coating

The enhancement of the resistance to secular peeling of the galvanized coating due to Sb, which is one of the most characterizing features according to the present invention, is clearly demonstrated in all of the examples Nos. 1~50 according to the present invention. In the comparative examples Nos. 51, 56, 61 and 62, the Sb amount lies outside the lower limit. In these comparative examples, the galvanized coating is secularly degraded. It is clear that the secular degradation of galvanized coating is a phenomenon that occurs irrespective of the Al amounts; in order to prevent this active Al must converted to eutectic as AlSb and hence made inert with the aid of Sb; and further, the Sb amount necessary for the prevention is at least 0.1 wt %. In the comparative examples Nos. 54 and 55, the Mg amount exceeds the limit and in the comparative examples Nos. 67 and 68, the amount of impurities exceeds the limit. In these comparative examples, the brittle fracturing and intergranular corrosion of the galvanized coating are promoted by the Sb addition, which thus leads to detrimental effects.

(2) Corrosion resistance of unpainted sheet

In the present invention, it is proposed that Al, Si, and Mg are effective for providing a high corrosion resistance of the galvanized layer. Such effects are shown in Example Nos. 1~5 for Al, examples Nos. 10~14 for Si, and example Nos. 15~21 for Mg. These effects are clarified when compared with the comparative examples Nos. 52~60.

The corrosion resistance of Zn is enhanced with the Al amount due to the formation of the eutectic of Zn-Al, which presumably enhances the corrosion potential of Zn and hence suppresses the anodization of Zn ($Zn \rightarrow Zn^{2+} + 2e$). Mg is compatible with any elements of Zn and Al and forms eutectic therewith. Mg has an effect of protecting a $\beta$-Zn phase and suppressing oxidation, i.e., solution, of a $\beta$-Zn phase, presumably, because Mg crystallizes in the $\beta$-Zn phase and suppresses contact corrosion with $\alpha$-Zn, and also forms a stable Mg oxide film.

Si is effective for enhancing the corrosion resistance, presumably because Si segregates mainly in the grain boundaries, and forms a stable oxide film which suppresses the oxidation, i.e., solution, of th $\beta$-Zn phase.

As described above, the functions of respective alloying elements for providing a high corrosion resistance appear to be different from one another but to be common in the point of forming any form of eutectic with Zn, which is the base metal of a galvanized coating. This is an important point for providing a high corrosion resistance. Presumably, the eutectic formation broadens the passivated region of Zn and decreases the corrosion current.

(3) Adherence of galvanized coating

It is a primary condition for materializing a galvanized steel sheet as an article of commerce that the galvanizing adherence is enhanced by suppressing an abnormal growth of the Fe alloy layer formed at an interface between the steel sheet and the galvanized coating. The uniform formation of a ternary Fe-Al-Zn alloy layer is the most significant factor for ensuring the adherence. In the comparative examples Nos. 51~55, the adherence is poor, possibly because the barrier effect due to the ternary alloy is poor so that the growth of a binary Fe-Zn alloy layer is abnormal. On the other hand, when the Al amount is too great, the Fe-Al alloy layer appears to abnormally develop. This is suggested by comparative examples Nos. 56~60. It is important therefore, as shown in examples Nos. 1~50 according to the present invention, that an appropriate range of Al be selected so as to ensure a good adherence of the galvanizing layer. In addition, examples Nos. 10~14 clearly show the effects of Si for enhancing the adherence of galvanizing. It is therefore understood that Si is as effective as Al for suppressing the Fe alloy layer.

(4) Galvanized appearance

The addition of Sb has an object of obtaining a spangled appearance necessitated by a specific article of commerce. In addition, the addition of misch metals has an object of obtaining an appearance which is smooth, highly lustered and pleasing. In examples Nos. 22, 27, and 32 according to the present invention, the spangled appearance obtained by natural cooling is coarse due to Sb. When Sb and misch metal are copresent, as in examples Nos. 37, 38 39, 44, and 45, coarse spangles having a further improved smoothness are obtained. In addition, an appropriate rapid-cooling enables an appearance having excellent five spangles to be obtained, as in examples Nos. 23~26, 28~31, and 33~36 according to the present invention, with the Sb addition. In the examples Nos. 40~43 and 46~50, because of the misch metal addition and cooling under the identical condition, an appearance with further excellent fine spangles is obtained.

I claim:

1. A Zn-Al hot-dip galvanized steel sheet having improved corrosion-resistance and resistance against secular peeling, and having a hot-dip galvanized coating on a low carbon steel sheet using a galvanizing bath which contains from 0.15 to 10% Al, from 0.2 to 1% of Sb, from 0.01 to 2% of Si, and balance being Zn and unavoidable impurities such as Pb, Sn, and Cd in an amount less than 0.02%, and additionally contains from 0.01 to 1% of at least one member selected from the group consisting of Mg and mischmetal.

2. A Zn-Al hot-dip galvanized steel sheet according to claim 1, wherein, directly before solidification of the galvanized coating while in a semimolten state, there is the step of blowing a mist of a phosphate aqueous solution onto the galvanized coating thereby rapidly cooling the galvanized coating at a speed of from 50° to 300° C./second.

3. A Zn-Al hot-dip galvanized steel sheet having improved corrosion resistance and resistance to secular peeling, said galvanized steel sheet being produced by a method comprising:

hot-dipping a low carbon steel sheet into a galvanizing bath which contains from 0.15 to 10% of Al, from 0.2 to 1% of Sb, from 0.01 to 2% of Si, and a balance being Zn and unavoidable impurities such as Pb, Sn, and Cd in an amount less than 0.02%, and additionally containing from 0.01 to 1% of at least one member selected from the group consisting of Mg and mischmetal.

4. A Zn-Al hot-dip galvanized steel sheet according to claim 3 wherein, directly before solidification of a galvanized coating while in a semimolten state, said method further includes blowing a mist of phosphate aqueous solution onto the galvanized coating thereby rapidly cooling the galvanized coating at a speed of from 50° to 300° C./second.

* * * * *